US011847912B1

(12) United States Patent
Clark et al.

(10) Patent No.: US 11,847,912 B1
(45) Date of Patent: Dec. 19, 2023

(54) SYSTEMS AND METHODS FOR GENERATING TRAFFIC WORK ZONES

(71) Applicant: Traffic Safety Technologies, LLC, Fairfield, VA (US)

(72) Inventors: Ryan Clark, Fairfield, VA (US); Shan Watkins, Rockbridge Baths, VA (US)

(73) Assignee: Traffic Safety Technologies, LLC, Fairfield, VA (US)

( * ) Notice: Subject to any disclaimer, the term of this patent is extended or adjusted under 35 U.S.C. 154(b) by 0 days.

(21) Appl. No.: 18/170,959

(22) Filed: Feb. 17, 2023

(51) Int. Cl.
*G08G 1/0967* (2006.01)

(52) U.S. Cl.
CPC ..... *G08G 1/0967* (2013.01)

(58) Field of Classification Search
CPC ..... G08G 1/0967
See application file for complete search history.

(56) References Cited

U.S. PATENT DOCUMENTS

2012/0065944 A1* 3/2012 Nielsen ..... G06Q 50/06 703/1
2022/0180455 A1* 6/2022 Hourdos ..... G06Q 50/08
2023/0160713 A1* 5/2023 Xu ..... G01C 21/3815 701/533
2023/0204372 A1* 6/2023 Xu ..... G06V 20/588 701/117

* cited by examiner

*Primary Examiner* — Peter D Nolan
*Assistant Examiner* — Demetra R Smith-Stewart
(74) *Attorney, Agent, or Firm* — TROUTMAN PEPPER HAMILTON SANDERS LLP; Scott A. Bergeson; Celeste K. Walker

(57) ABSTRACT

Disclosed embodiments may include a system for generating traffic work zones. The system may receive, via a first GUI of a user device, a first request to generate a traffic work zone, the first request comprising at least a location of the traffic work zone. Responsive to receiving the first request, the system may retrieve, via a database, one or more regulations associated with the location of the traffic work zone; determine, based on the one or more regulations, one or more required materials associated with the location of the traffic work zone; generate a second GUI configured to display a map of the location of the traffic work zone and at least one of the one or more required materials overlaid on the map; and cause the user device to display the second GUI.

18 Claims, 10 Drawing Sheets

SYSTEMS AND METHODS FOR GENERATING TRAFFIC WORK ZONES

FIELD

The disclosed technology relates to systems and methods for generating traffic work zones, and more particularly, for generating a dynamic map of a work zone location based on user input.

BACKGROUND

Traditional systems and methods for generating traffic work zones typically require users, such as work zone managers and/or employees, to manually design an adequate work zone based on the location, conditions, and/or purpose of the traffic work zone. For example, a work zone manager may be required to calculate the correct distance of road that must be closed, and the correct number and/or types of signage or equipment necessary, to handle a street closure for a period of time.

Accordingly, there is a need for improved systems and methods for generating traffic work zones. Embodiments of the present disclosure are directed to this and other considerations.

SUMMARY

Disclosed embodiments may include a system for generating traffic work zones. The system may include one or more processors, and memory in communication with the one or more processors and storing first instructions that are configured to cause the system to perform a method for generating traffic work zones. The system may cause a user device to display a first graphical user interface (GUI) that includes a plurality of editable fields associated with a traffic work zone. The system may receive, via the first GUI, one or more selections associated with the plurality of editable fields, wherein at least one of the one or more selections comprises a work zone location. Responsive to receiving the one or more selections, the system may retrieve, via a database, one or more regulations associated with the work zone location; determine, based on the one or more regulations, one or more required materials associated with the work zone location; generate a second GUI configured to display a map of the work zone location and at least one of the one or more required materials overlaid on the map; and cause the user device to display the second GUI.

Disclosed embodiments may include a system for generating traffic work zones. The system may include one or more processors, and memory in communication with the one or more processors and storing first instructions that are configured to cause the system to perform a method for generating traffic work zones. The system may generate a first GUI that includes a plurality of editable fields associated with a traffic work zone. The system may cause a user device to display the first GUI. The system may receive, via the first GUI, one or more selections associated with the plurality of editable fields, wherein at least one of the one or more selections comprises a work zone location. Responsive to receiving the one or more selections, the system may determine one or more required materials associated with the work zone location; generate a second GUI configured to display a map of the work zone location; cause the user device to display the second GUI; receive location data associated with the user device; responsive to receiving the location data, determine whether the user device has reached a first position within the work zone location; and responsive to determining the user device has reached the first position, cause the user device to transmit a first alert indicating a first material of the one or more required materials should be placed at the first position.

Disclosed embodiments may include a system for generating traffic work zones. The system may include one or more processors, and memory in communication with the one or more processors and storing first instructions that are configured to cause the system to perform a method for generating traffic work zones. The system may receive, via a first GUI of a user device, a first request to generate a traffic work zone, the first request comprising at least a location of the traffic work zone. Responsive to receiving the first request, the system may retrieve, via a database, one or more regulations associated with the location of the traffic work zone; determine, based on the one or more regulations, one or more required materials associated with the location of the traffic work zone; generate a second GUI configured to display a map of the location of the traffic work zone and at least one of the one or more required materials overlaid on the map; and cause the user device to display the second GUI.

Further implementations, features, and aspects of the disclosed technology, and the advantages offered thereby, are described in greater detail hereinafter, and can be understood with reference to the following detailed description, accompanying drawings, and claims.

BRIEF DESCRIPTION OF THE DRAWINGS

Reference will now be made to the accompanying drawings, which are not necessarily drawn to scale, and which illustrate various implementations, aspects, and principles of the disclosed technology. In the drawings.

DETAILED DESCRIPTION

Figure 1:
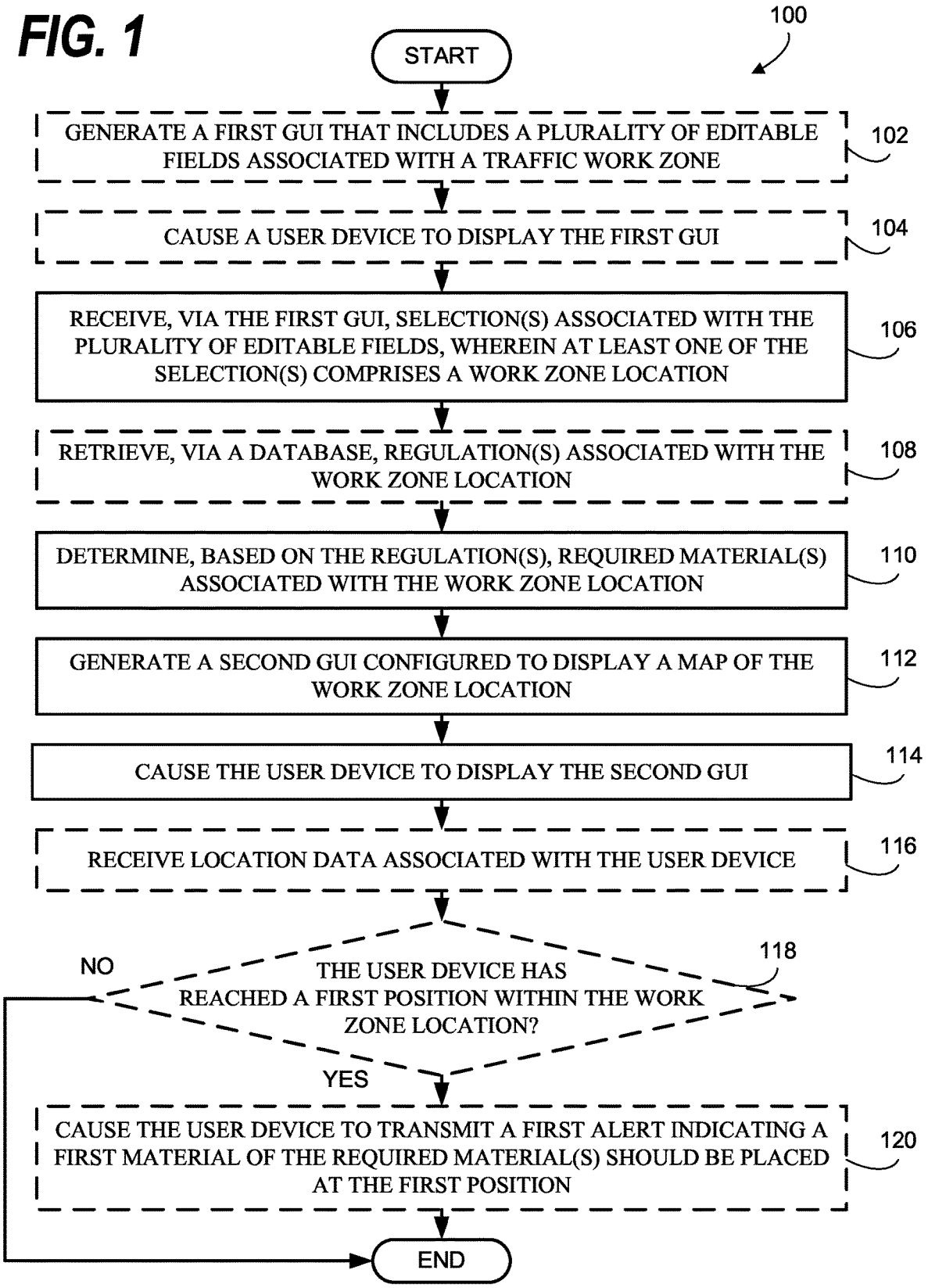
FIG. 1 is a flow diagram illustrating an exemplary method for generating traffic work zones, according to an example implementation of the disclosed technology.

Traditional systems and methods for generating traffic work zones typically require users, such as work zone managers and/or employees, to design an adequate work zone based on the location, conditions, and/or purpose of the traffic work zone. For example, a work zone manager may be required to arrive at a job site to calculate the correct distance of road that must be closed, and the correct number and/or types of signage or equipment necessary, to handle a street closure for a period of time. In some instances, the work zone manager may have to enlist a graphical designer to generate a technical drawing for a temporary traffic control plan submission to a transportation department (e.g., Virginia Department of Transportation (VDOT)). Users may face challenges with these traditional systems and methods due to the amount of time required to design an adequate work zone, and/or the potential inability to efficiently modify a traffic work zone design throughout a given job. Additionally, users may not be able to plan out the required materials, personnel, etc., for a work zone until they have arrived on the scene to survey the road or land, which can lead to downtime and loss of efficiency. Finally, users may not be aware of any applicable regulations (e.g., national-, local-, county-based, etc.) that may impact how a particular work zone must be designed.

Accordingly, examples of the present disclosure relate to systems and methods for generating traffic work zones. In particular, the disclosed technology provides for receiving, via a first GUI of a user device, a request to generate a traffic work zone; retrieving regulation(s) associated with the location of the traffic work zone; determining required material(s) associated with the traffic work zone location based on the regulation(s); generating a second GUI configured to display a map of the traffic work zone location with at least one of the required material(s) overlaid on the map; and causing the user device to display the second GUI. In some instances, the disclosed technology includes automatically and dynamically generating a traffic control plan, which includes the map of the traffic work zone with the at least one required material(s), for submission to a department of transportation (e.g., VDOT).

The systems and methods described herein are thus necessarily rooted in computer and technology as they utilize, in some instances, graphical user interfaces (GUIs), which are a computer technology that allows for user interaction with computers through touch, pointing devices, or other means. This may involve, in some examples, using user-specific input data to dynamically change the GUI so that the GUI is configured to display features and/or required materials associated with a traffic work zone. Additionally, the systems and methods described herein may improve, in some instances, the speed with which computers can generate and/or modify dynamic map displays.

This may provide an advantage and improvement over prior technologies that may not provide a way to customize and/or dynamically generate or modify map displays and associated plans for dynamic submission to transportation departments. The present disclosure solves this problem by allowing for the receipt of selections associated with a plurality of editable fields within a GUI, and the dynamic generation and/or modification of a map display based on the selections. Overall, the systems and methods disclosed have significant practical applications in the traffic work and safety fields because of the noteworthy improvements of the customization and generation of traffic work zones, which are important to solving present problems with this technology.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods.

Reference will now be made in detail to example embodiments of the disclosed technology that are illustrated in the accompanying drawings and disclosed herein. Wherever convenient, the same reference numbers will be used throughout the drawings to refer to the same or like parts.

FIG. 1 is a flow diagram illustrating an exemplary method 100 for generating traffic work zones, in accordance with certain embodiments of the disclosed technology. The steps of method 100 may be performed by one or more components of the system 300 (e.g., work zone map generation system 220 or web server 310 of traffic safety system 308, or user device 302), as described in more detail with respect to FIGS. 2 and 3. The steps of method 100 may be further performed via one or more of the exemplary graphical user interfaces (GUIs), as illustrated in FIGS. 4A-4G and discussed below. While certain blocks may be identified as being optional, certain embodiments may omit blocks even if they are not necessarily identified as being optional.

Figure 4A:
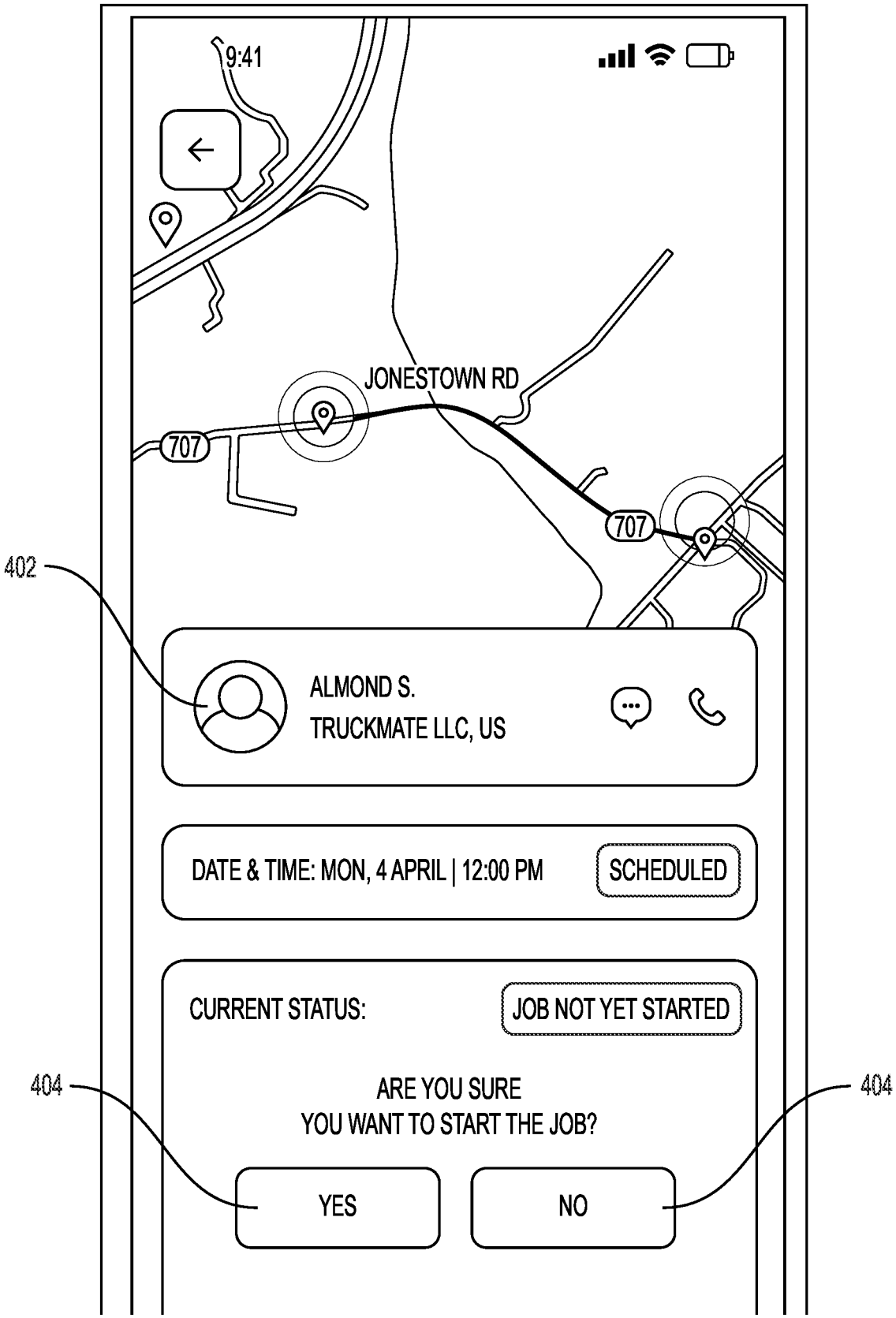
FIGS. 4A-4G are exemplary graphical user interfaces that may be utilized for generating traffic work zones, according to an example implementation of the disclosed technology.
Figure 4B:
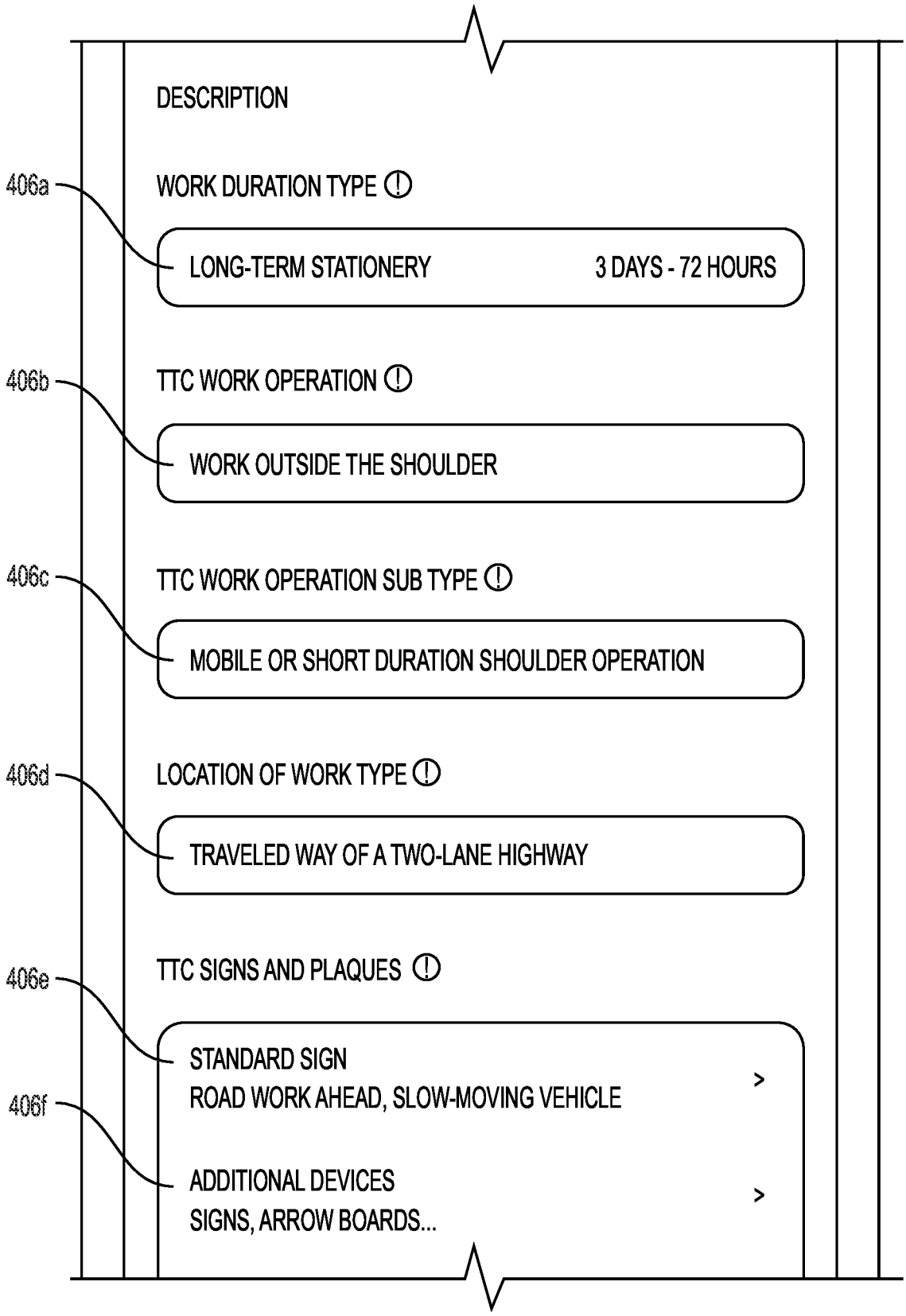
Figure 4C:
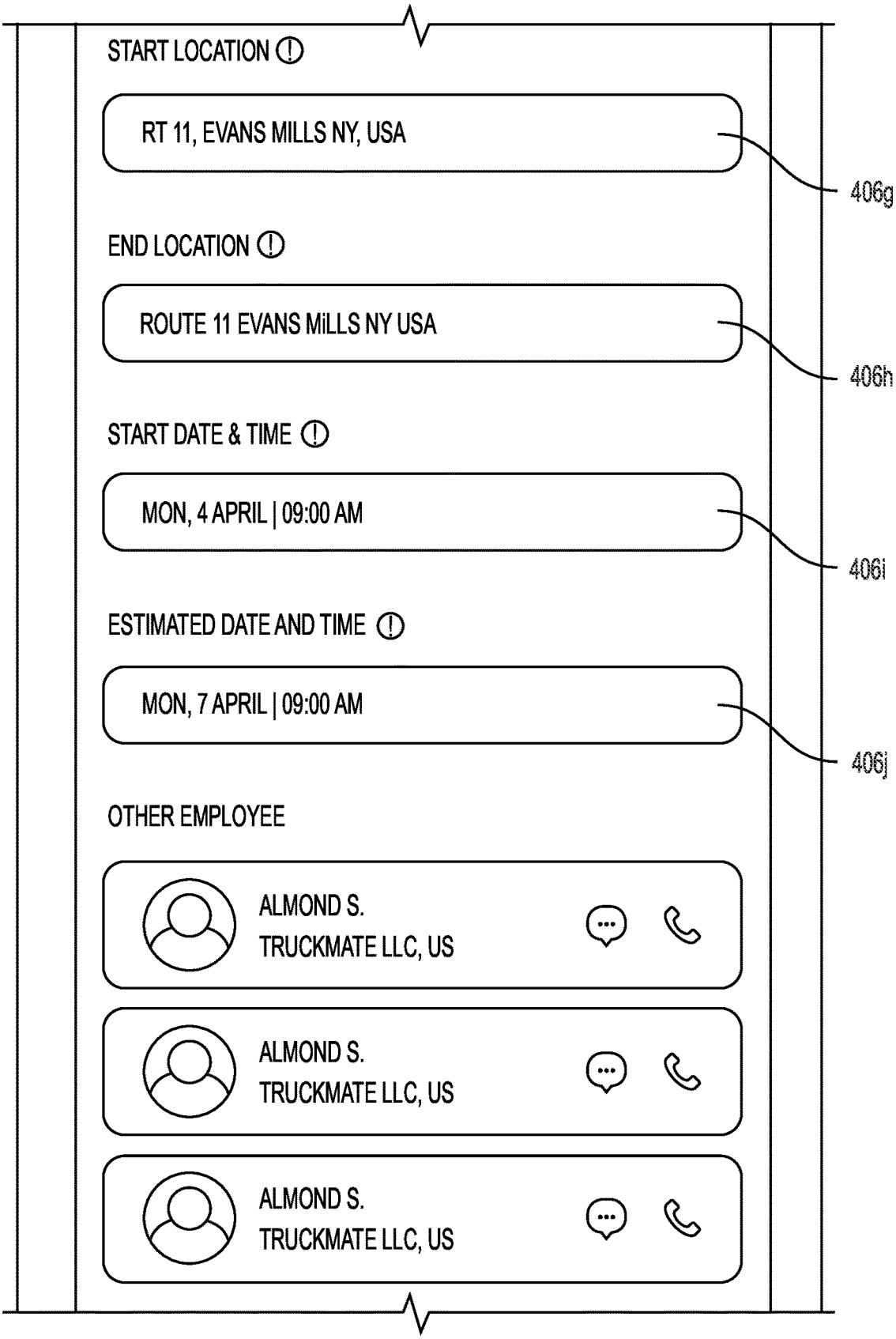

In optional block 102, work zone map generation system 220 may generate a first GUI (e.g., FIGS. 4A-4C) that includes a plurality of editable fields associated with a traffic work zone. In some embodiments, the first GUI may be one of a plurality of GUIs configured for display via an application, such as a mobile or web application. In some embodiments, the plurality of editable fields may include user input objects configured such that a user (e.g., a user of user device 302) may make selections as to desired details associated with a traffic work zone request, as further discussed below. For example, FIG. 4A is an exemplary GUI that may enable a user 402 to click on one or more selectable user input objects (e.g., buttons) 404 to begin to generate a traffic work zone, or a traffic control plan, as discussed herein. FIGS. 4B-4C are exemplary GUIs that may then enable the user 402 to provide information, e.g., via selectable fields 406*a-j*, describing the requested traffic work zone, such as the work duration type (406*a*), any required signs (406*e*) or devices (406*f*), the start and end locations (406*g*, 406*h*), and the start and end date and time (406*i*, 406*j*).

In optional block 104, work zone map generation system 220 may cause a user device (e.g., user device 302) to display the first GUI. For example, as discussed above, the first GUI may be displayed via an application, such as a mobile or web application, as illustrated in FIGS. 4A-4C.

In block 106, work zone map generation system 220 may receive, via the first GUI, a first request to generate a traffic work zone. In some embodiments, the first request may include one or more selections associated with the plurality of editable fields of the first GUI. For example, as particularly illustrated in FIGS. 4B-4C and discussed above, the editable fields may be associated with traffic work zone details, such as a date, a start and/or end time, a work zone location (e.g., an address, a street name, a neighborhood, etc.), a work zone purpose (e.g., underground pipe work), a work zone type (e.g., lane closure), an employee name, employee identification information (e.g., an employee identification number), an employee experience level (e.g., number of years on a job), and the like. In some embodiments, the purpose of the first GUI may be for a user, such as a traffic work zone manager or employee, to aid the system in generating a traffic work zone and/or a traffic control plan, as discussed herein. In some embodiments, the purpose of the first GUI may be to begin generating a traffic control plan for submission to a department of transportation, as discussed herein. For example, a traffic control plan may include a map of a traffic work zone with at least one required material(s) overlaid on the map. The traffic control plan may further include notes or additional details associated with the traffic work zone, such as where materials (e.g., signs) may be placed, where a shoulder or lane taper may occur, a total number of lanes involved and/or closed to through traffic, whether the traffic work zone will be conducted at night or during the daytime, and the like. The traffic control plan may further name(s) of people designing and/or reviewing the generated traffic control plan, and/or open fields (e.g., lines, boxes, etc.) such that the reviewer, such as an individual from a department of transportation, may sign and/or date the traffic control plan, and/or provide additional comments.

In some embodiments, the system may be configured to receive the first request, or certain selections associated with the first request, via a Quick Response (QR) code scanning device. For example, a user (e.g., a work zone employee) may use his/her mobile device, e.g., via a mobile application, to scan a QR code printed on his/her identification badge. The system may then receive information associated with the employee, such as name, phone number, assigned manager, employee identification number, etc. In this way, the system may be configured to track each employee working on a specific job site for display of an employee listing via a GUI, as illustrated in FIG. 4C. In some embodiments, as particularly shown in FIG. 4C, the system may be configured to display one or more user input objects proximate each employee name, such that employees can message or call one another, e.g., via a mobile application.

In optional block 108, responsive to receiving the one or more selections, work zone map generation system 220 may retrieve, via a database, one or more regulations associated with the work zone location. In some embodiments, the regulations may include, for example, national-, state-, local-, country-, city-based, etc., regulations pertaining to how to create proper work zones for various types of traffic work. For example, national regulations in the United States for designing work zones are laid out by the Manual on Uniform Traffic Control Devices (MUTCD), while state regulations in the state of Virginia require work zones be designed based on the Work Area Protection Manual.

In block 110, work zone map generation system 220 may determine, based on the regulation(s), one or more required materials associated with the work zone location. In some embodiments, the required material(s) may include, for example, a flag, a cone, a sign, a marker, and the like.

Figure 4D:
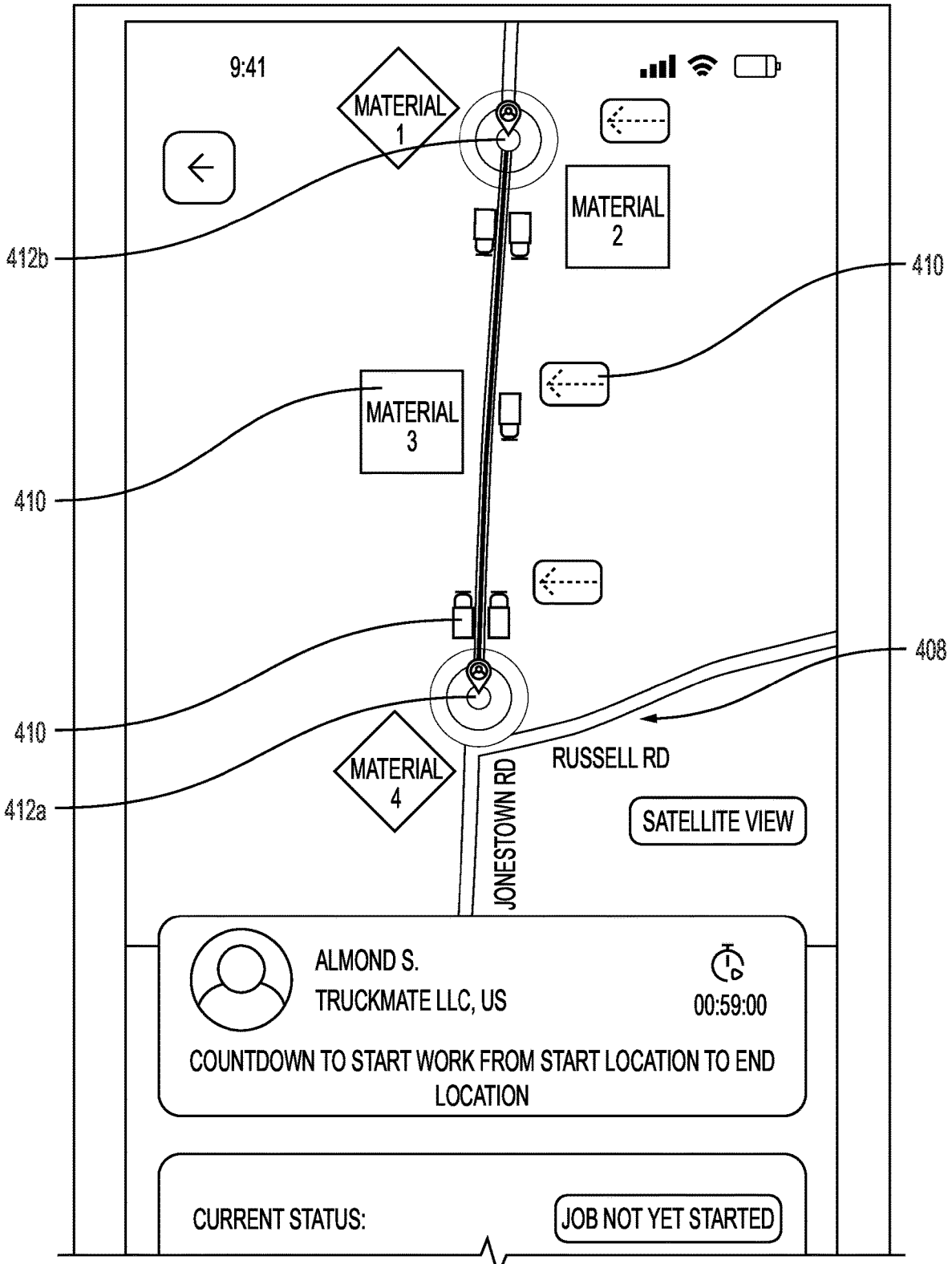
Figure 4E:
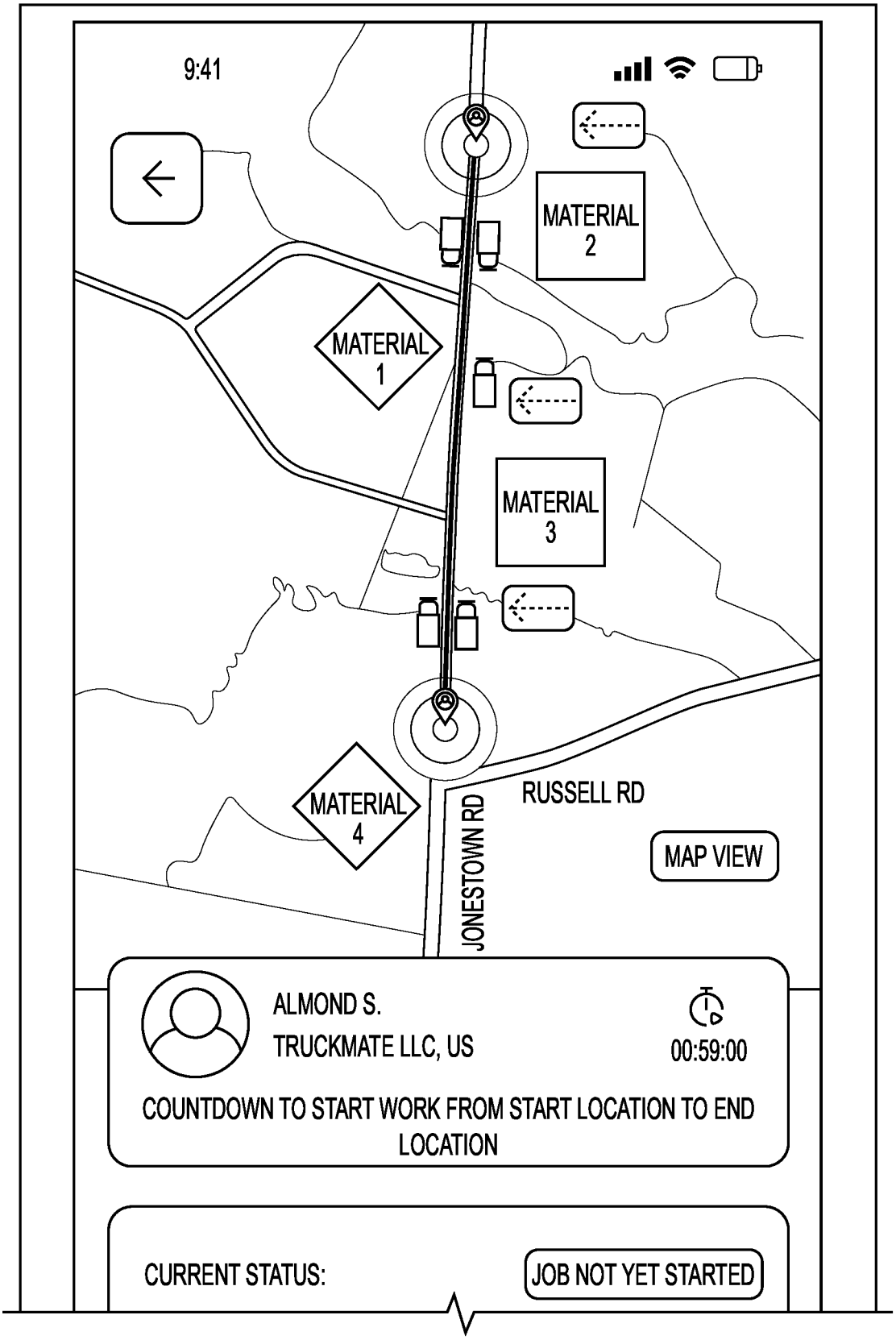

In block 112, work zone map generation system 220 may generate a second GUI (e.g., FIGS. 4D-4E) configured to display a map of the work zone location. In some embodiments, the map of the work zone location may depict various components of the work zone, such as an address or location, a distance (e.g., number of feet, yards, miles, etc.), such as based on the work zone location and/or a speed limit corresponding to the work zone location, and/or one or more features of the work zone location, such as curvature of a road, a change in elevation, and the like. In some embodiments, the map may include a satellite view of the work zone location (e.g., FIG. 4D), or a map view of the work zone location (e.g., FIG. 4E). For example, FIGS. 4D-4E are exemplary GUIs that may be configured to display a generated map of a requested work zone location. The map may include the location of the work zone, such as the applicable street name(s) 408, one or more overlaid materials 410, such as signs, work vehicles, etc., start and end locations 412*a*, 412*b* of the work zone, and the like.

In some embodiments, the second GUI may be further configured to display at least one of the one or more required materials overlaid on the map. For example, as particularly shown in the exemplary GUIs in FIGS. 4D-4E, the map may depict not only the location of the work zone location, including one or more of the above-mentioned components and/or features, but also at least one of the required materials (e.g., a sign or cone) overlaid on the map. A benefit of this overlaid may be that a user may be able to understand exactly where a certain required material should be positioned within the work zone, as further discussed below.

In block 114, work zone map generation system 220 may cause the user device (e.g., user device 302) to display the second GUI. In some embodiments, as discussed above, the system may cause the user device to display the second GUI via an application, such as a mobile or web application.

In some embodiments, the system may receive real-time image or video footage of the work zone location, such as via a Bluetooth™ of other type of real-time connection with the user device (e.g., user device 302). A benefit of this feature is it may enable a remote user, such as a local work zone supervisor or inspector, to review and/or inspect a work zone as it is being set up or while it is in use.

In some embodiments, the system may receive, via a third GUI of the user device, a request to change at least a first selection of the one or more selections. For example, a user may change, via the third GUI of a mobile application, the end time associated with a work zone should the traffic team decide they'll need more time to complete the road work. Responsive to receiving the request, the system may determine, based on the one or more regulation(s) (as discussed above), one or more updated required materials associated with the work zone location, such as a different total number of materials and/or different types of materials. In some embodiments, the system may modify the second GUI to generate a modified second GUI configured to display an updated map of the work zone location. In some embodiments, the modified second GUI may be further configured to display the one or more updated materials overlaid on the updated map. In some embodiments, the system may cause the user device to display the modified second GUI.

In optional block 116, responsive to receiving the one or more selections, work zone map generation system 220 may receive location data associated with the user device. For example, the system may be configured to continuously receive a Global Navigation Satellite System (GNSS) such as a Global Positioning System (GPS) signal associated with the user device when the user device is connected to a network (e.g., network 306), and/or operating via cell phone service.

In optional block 118, responsive to receiving the location data, work zone map generation system 220 may determine whether the user device has reached a first position within the work zone location. In some embodiments, the first position may be, for example, the start of the work zone location, or at a specific distance (e.g., 25 feet) along the length of the work zone.

In optional block 120, responsive to determining the user device has reached the first position, work zone map generation system 220 may cause the user device to transmit a first alert indicating a first material of the one or more required materials should be placed at the first position. In some embodiments, the alert may include an in-application alert (e.g., a banner or pop-up notification within a mobile or web application), an SMS message, a chat message, a push-notification, and the like. In some embodiments, the alert may indicate that the user should place a certain material (e.g., a specific sign) at the first position.

Figure 4F:
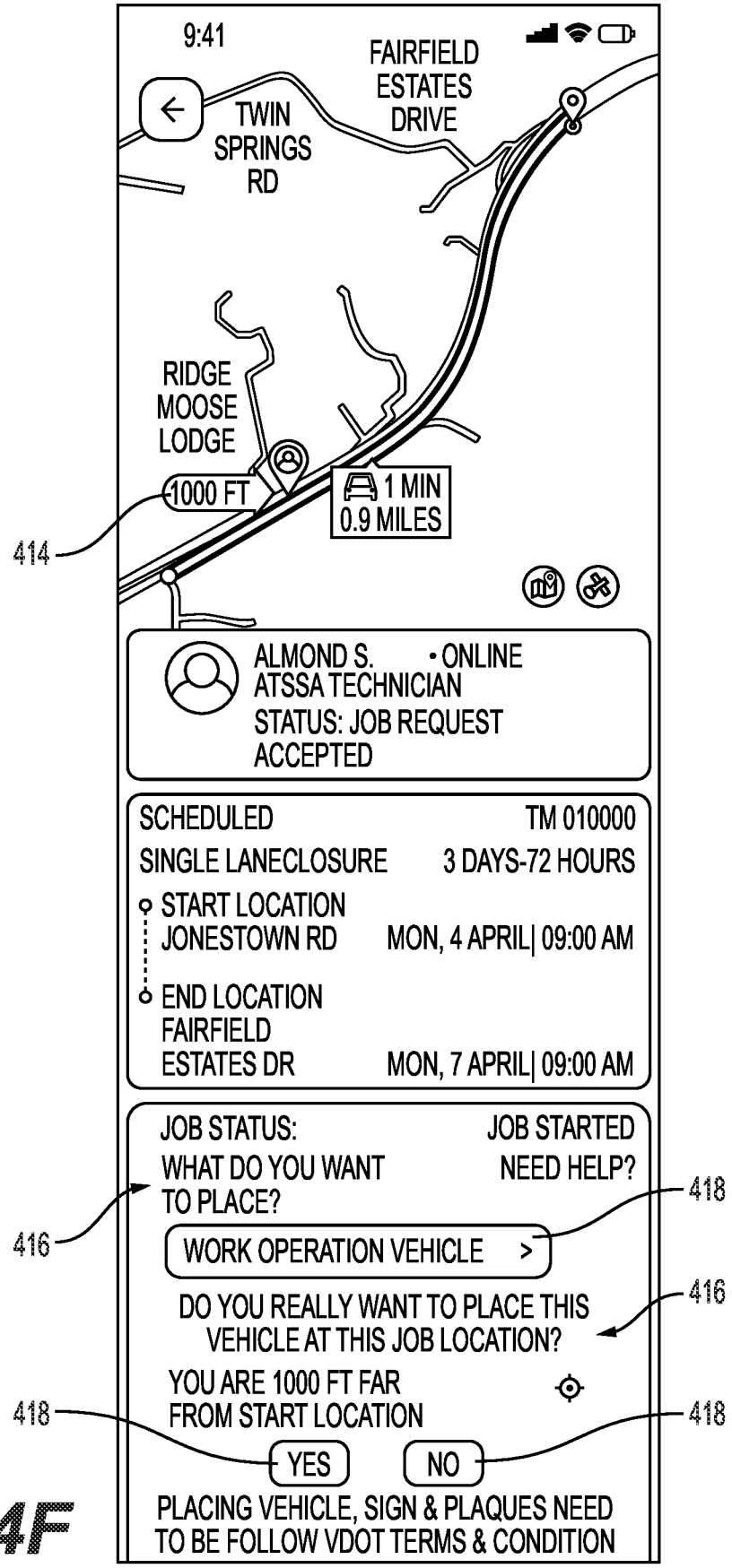
Figure 4G:
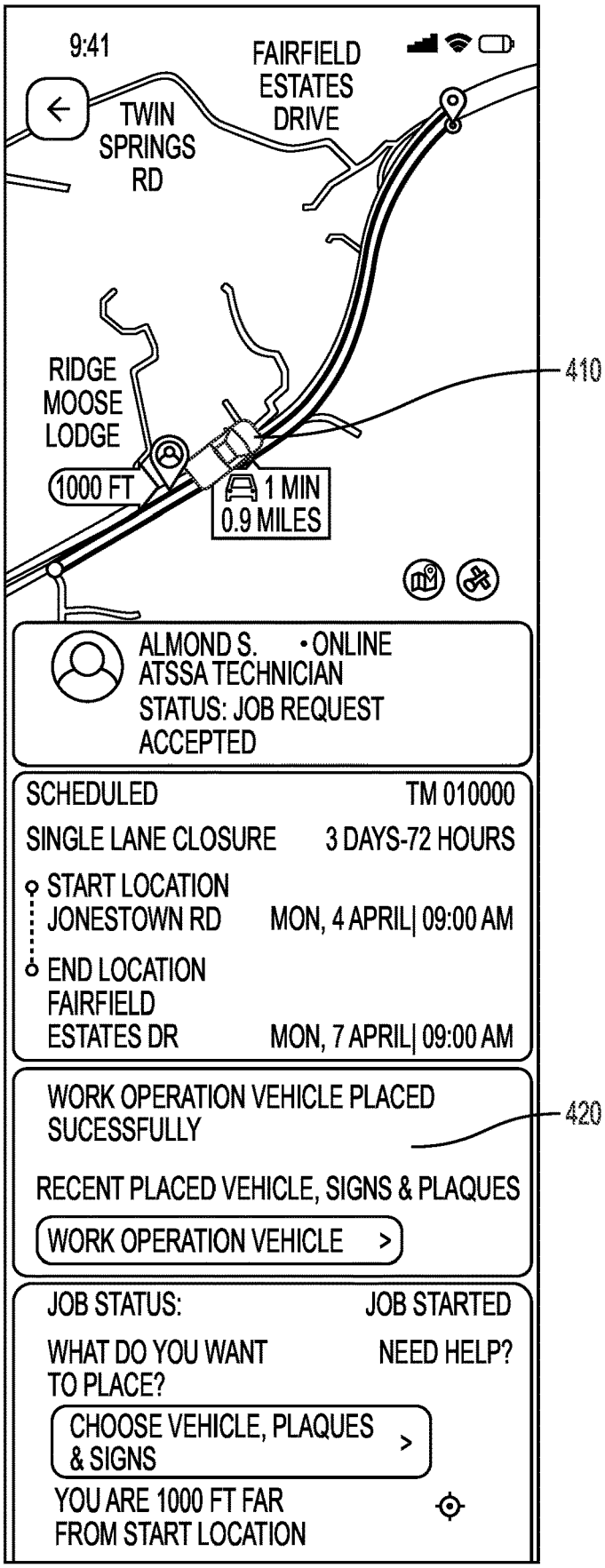

For example, FIGS. 4F-4G are exemplary GUIs that may be configured to display the work zone location, and a current location 414 of the user, e.g., 1,000 feet from the starting location 412*a* of the work zone. The GUIs may further be configured to display one or more prompts 416 requesting the user confirm what type of material 410, e.g., a work operation vehicle, the user wishes to place at a position along the work zone. The GUIs may further be configured to display one or more selectable user input objects 418 configured to enable the user to respond to the one or more prompts 416. Once the user places the material 410 at the appropriate position along the work zone, the GUI may display a notification 420 indicating the material was successfully placed.

In some embodiments, responsive to receiving the selection(s), as discussed above, the system may be configured to iteratively receive the location data associated with the user device until each of the one or more required material(s) has been placed at a respective position within the work zone location. For example, if the system determines that twenty different materials are required based on the regulation(s) associated with the work zone location, as discussed above, the system may be configured to iteratively receive location data associated with the user device until each of the twenty materials has been placed, and/or the system has transmitted a respective alert to the user indicating each of the twenty materials should be placed at a respective position, as discussed above.

In some embodiments, responsive to receiving the selection(s), as discussed above, the system may be configured to continuously receive the location data associated with the user device, and to continuously determine a distance between the location data and a first position within the work zone location. In some embodiments, the system may continuously determine whether the distance is below a threshold level (e.g., a specific distance along the length of the work zone). The system may cause the user device to dynamically display the distance via the second GUI. For example, the system may dynamically modify the second GUI such that as the user device moves locations, the modified second GUI displays the distance between the current location of the user device, and a specific location along the length of the work zone. In some embodiments, the system may cause the user device to display, via the modified second GUI, an indication that a first material of the one or more required material(s) should be placed at the first position when the distance is below the threshold level. For example, the system may be configured to determine that certain materials may be placed at multiple locations within the work zone as long as those locations do not exceed a certain distance away from the last location where a required material was placed.

In some embodiments, responsive to receiving the selection(s), as discussed above, the system may determine a distance associated with the work zone location, such as a total length (e.g., in feet, yards, miles, etc.) of the work zone location. In some embodiments, the system may cause the user device to display the distance via the second GUI. In some embodiments, the system may determine one or more features associated with the work zone location, such as a curvature of the road, a change in elevation, etc. that may impact the required distance for the work zone location, such as from a safety perspective. In some embodiments, the system may automatically modify the distance based on the one or more features. For example, if the system determines there is a sharp curvature in the road, such that it may reduce visibility of drivers who drive along the work zone, the system may be configured to modify (e.g., extend) the initial distance of the work zone location. In some embodiments, the system may cause the user device to display the modified distance via the second GUI.

Figure 2:
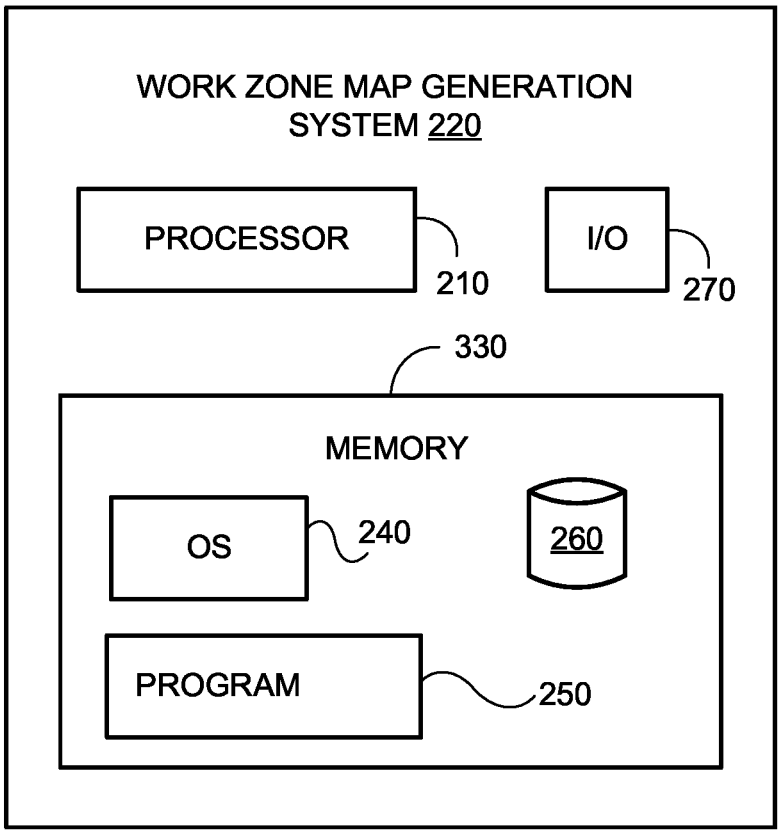
FIG. 2 is a block diagram of an example work zone map generation system used to generate traffic work zones, according to an example implementation of the disclosed technology.
Figure 3:
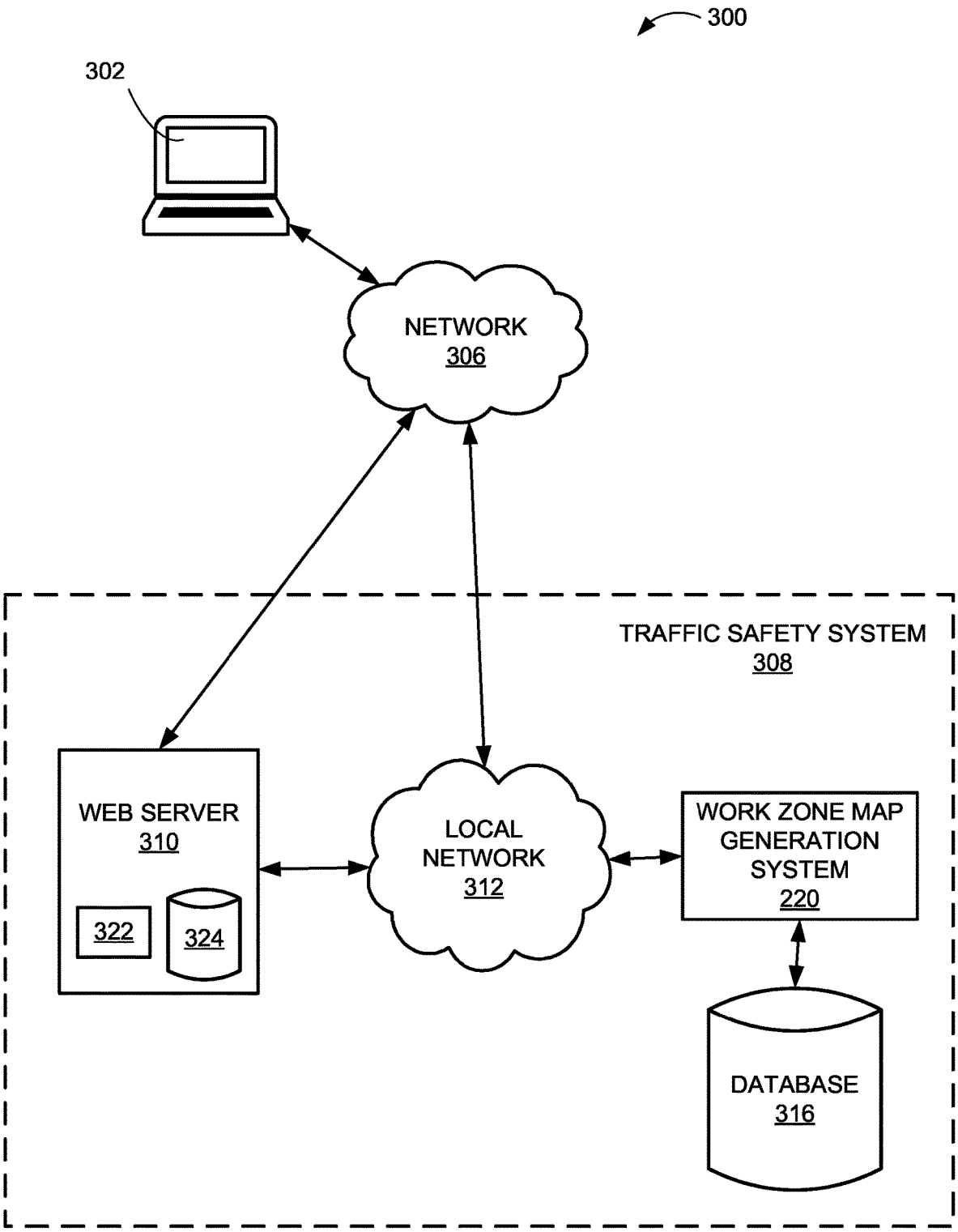
FIG. 3 is a block diagram of an example system used to generate traffic work zones, in accordance with certain embodiments of the disclosed technology.

FIG. 2 is a block diagram of an example work zone map generation system 220 used to generate traffic work zones, according to an example implementation of the disclosed technology. According to some embodiments, the user device 302 and web server 310, as depicted in FIG. 3 and described below, may have a similar structure and components that are similar to those described with respect to work zone map generation system 220 shown in FIG. 2. As shown, the work zone map generation system 220 may include a processor 210, an input/output (I/O) device 270, a memory 230 containing an operating system (OS) 240 and a program 250.

In certain example implementations, the work zone map generation system 220 may be a single server or may be configured as a distributed computer system including multiple servers or computers that interoperate to perform one or more of the processes and functionalities associated with the disclosed embodiments. In some embodiments work zone map generation system 220 may be one or more servers from a serverless or scaling server system. In some embodiments, the work zone map generation system 220 may further include a peripheral interface, a transceiver, a mobile network interface in communication with the processor 210, a bus configured to facilitate communication between the various components of the work zone map generation system 220, and a power source configured to power one or more components of the work zone map generation system 220.

A peripheral interface, for example, may include the hardware, firmware and/or software that enable(s) communication with various peripheral devices, such as media drives (e.g., magnetic disk, solid state, or optical disk drives), other processing devices, or any other input source used in connection with the disclosed technology. In some embodiments, a peripheral interface may include a serial port, a parallel port, a general-purpose input and output (GPIO) port, a game port, a universal serial bus (USB), a micro-USB port, a high-definition multimedia interface (HDMI) port, a video port, an audio port, a Bluetooth™ port, a near-field communication (NFC) port, another like communication interface, or any combination thereof.

In some embodiments, a transceiver may be configured to communicate with compatible devices and ID tags when they are within a predetermined range. A transceiver may be compatible with one or more of: radio-frequency identification (RFID), NFC, Bluetooth™, low-energy Bluetooth™ (BLE), WiFi™, ZigBee™, ambient backscatter communications (ABC) protocols or similar technologies.

A mobile network interface may provide access to a cellular network, the Internet, or another wide-area network (WAN) or local area network (LAN). In some embodiments, a mobile network interface may include hardware, firmware, and/or software that allow(s) the processor(s) 210 to communicate with other devices via wired or wireless networks, whether local or wide area, private or public, as known in the art. A power source may be configured to provide an appropriate alternating current (AC) or direct current (DC) to power components.

The processor 210 may include one or more of a microprocessor, microcontroller, digital signal processor, co-processor or the like or combinations thereof capable of executing stored instructions and operating upon stored data. The memory 230 may include, in some implementations, one or more suitable types of memory (e.g. such as volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like), for storing files including an operating system, application programs (including, for example, a web browser application, a widget or gadget engine, and or other applications, as necessary), executable instructions and data. In one embodiment, the processing techniques described herein may be implemented as a combination of executable instructions and data stored within the memory 230.

The processor 210 may be one or more known processing devices, such as, but not limited to, a microprocessor from the Core™ family manufactured by Intel™, the Ryzen™ family manufactured by AMD™, or a system-on-chip processor using an ARM™ or other similar architecture. The processor 210 may constitute a single core or multiple core processor that executes parallel processes simultaneously, a central processing unit (CPU), an accelerated processing unit (APU), a graphics processing unit (GPU), a microcontroller, a digital signal processor (DSP), a field-programmable gate array (FPGA), an application-specific integrated circuit (ASIC) or another type of processing component. For example, the processor 210 may be a single core processor that is configured with virtual processing technologies. In certain embodiments, the processor 210 may use logical processors to simultaneously execute and control multiple processes. The processor 210 may implement virtual machine (VM) technologies, or other similar known technologies to provide the ability to execute, control, run, manipulate, store, etc. multiple software processes, applications, programs, etc. One of ordinary skill in the art would understand that other types of processor arrangements could be implemented that provide for the capabilities disclosed herein.

In accordance with certain example implementations of the disclosed technology, the work zone map generation system 220 may include one or more storage devices configured to store information used by the processor 210 (or other components) to perform certain functions related to the disclosed embodiments. In one example, the work zone map generation system 220 may include the memory 230 that includes instructions to enable the processor 210 to execute one or more applications, such as server applications, network communication processes, and any other type of application or software known to be available on computer systems. Alternatively, the instructions, application programs, etc. may be stored in an external storage or available from a memory over a network. The one or more storage devices may be a volatile or non-volatile, magnetic, semiconductor, tape, optical, removable, non-removable, or other type of storage device or tangible computer-readable medium.

The work zone map generation system 220 may include a memory 230 that includes instructions that, when executed by the processor 210, perform one or more processes consistent with the functionalities disclosed herein. Methods, systems, and articles of manufacture consistent with disclosed embodiments are not limited to separate programs or computers configured to perform dedicated tasks. For example, the work zone map generation system 220 may include the memory 230 that may include one or more programs 250 to perform one or more functions of the disclosed embodiments. For example, in some embodiments, the work zone map generation system 220 may additionally manage dialogue and/or other interactions with the customer via a program 250.

The processor 210 may execute one or more programs 250 located remotely from the work zone map generation system 220. For example, the work zone map generation system 220 may access one or more remote programs that, when executed, perform functions related to disclosed embodiments.

The memory 230 may include one or more memory devices that store data and instructions used to perform one or more features of the disclosed embodiments. The memory 230 may also include any combination of one or more databases controlled by memory controller devices (e.g., server(s), etc.) or software, such as document management systems, Microsoft™ SQL databases, SharePoint™ databases, Oracle™ databases, Sybase™ databases, or other relational or non-relational databases. The memory 230 may include software components that, when executed by the processor 210, perform one or more processes consistent with the disclosed embodiments. In some embodiments, the memory 230 may include a database 260 for storing related data to enable the work zone map generation system 220 to perform one or more of the processes and functionalities associated with the disclosed embodiments.

The database 260 may include stored data relating to status data (e.g., average session duration data, location data, idle time between sessions, and/or average idle time between sessions) and historical status data. According to some embodiments, the functions provided by the database 260 may also be provided by a database that is external to the work zone map generation system 220, such as the database 316 as shown in FIG. 3.

The work zone map generation system 220 may also be communicatively connected to one or more memory devices (e.g., databases) locally or through a network. The remote memory devices may be configured to store information and may be accessed and/or managed by the work zone map generation system 220. By way of example, the remote memory devices may be document management systems, Microsoft™ SQL database, SharePoint™ databases, Oracle™ databases, Sybase™ databases, or other relational or non-relational databases. Systems and methods consistent with disclosed embodiments, however, are not limited to separate databases or even to the use of a database.

The work zone map generation system 220 may also include one or more I/O devices 270 that may comprise one or more interfaces for receiving signals or input from devices and providing signals or output to one or more devices that allow data to be received and/or transmitted by the work zone map generation system 220. For example, the work zone map generation system 220 may include interface components, which may provide interfaces to one or more input devices, such as one or more keyboards, mouse devices, touch screens, track pads, trackballs, scroll wheels, digital cameras, microphones, sensors, and the like, that enable the work zone map generation system 220 to receive data from a user (such as, for example, via the user device 302).

In examples of the disclosed technology, the work zone map generation system 220 may include any number of hardware and/or software applications that are executed to facilitate any of the operations. The one or more I/O interfaces may be utilized to receive or collect data and/or user instructions from a wide variety of input devices. Received data may be processed by one or more computer processors as desired in various implementations of the disclosed technology and/or stored in one or more memory devices.

The work zone map generation system 220 may be configured to classify a dataset. Classifying a dataset may include determining whether a dataset is related to another dataset. Classifying a dataset may include clustering datasets and generating information indicating whether a dataset belongs to a cluster of datasets. In some embodiments, classifying a dataset may include generating data describing the dataset (e.g., a dataset index), including metadata, an indicator of whether data element includes actual data and/or synthetic data, a data schema, a statistical profile, a relationship between the test dataset and one or more reference datasets (e.g., node and edge data), and/or other descriptive information. Edge data may be based on a similarity metric. Edge data may indicate a similarity between datasets and/or a hierarchical relationship (e.g., a data lineage, a parent-child relationship). In some embodiments, classifying a dataset may include generating graphical data, such as anode diagram, a tree diagram, or a vector diagram of datasets. Classifying a dataset may include estimating a likelihood that a dataset relates to another dataset, the likelihood being based on the similarity metric.

While the work zone map generation system 220 has been described as one form for implementing the techniques described herein, other, functionally equivalent, techniques may be employed. For example, some or all of the functionality implemented via executable instructions may also be implemented using firmware and/or hardware devices such as application specific integrated circuits (ASICs), programmable logic arrays, state machines, etc. Furthermore, other implementations of the work zone map generation system 220 may include a greater or lesser number of components than those illustrated.

FIG. 3 is a block diagram of an example system that may be used to generate traffic work zones, according to an example implementation of the disclosed technology. The components and arrangements shown in FIG. 3 are not intended to limit the disclosed embodiments as the components used to implement the disclosed processes and features may vary. As shown, traffic safety system 308 may interact with a user device 302 via a network 306. In certain example implementations, the traffic safety system 308 may include a local network 312, a work zone map generation system 220, a web server 310, and a database 316.

In some embodiments, a user may operate the user device 302. User device 302 can include one or more of a mobile device, smart phone, general purpose computer, tablet computer, laptop computer, telephone, PSTN landline, smart wearable device, voice command device, other mobile computing device, or any other device capable of communicating with network 306 and ultimately communicating with one or more components of the traffic safety system 308. In some embodiments, user device 302 may include or incorporate electronic communication devices for hearing or vision impaired users.

Users may include individuals such as, for example, employees, subscribers, clients, prospective clients, or customers of an entity associated with an organization, such as individuals who have obtained, will obtain, or may obtain a product, service, or consultation from or conduct a transaction in relation to an entity associated with the traffic safety system 308. According to some embodiments, user device 302 may include an environmental sensor for obtaining audio or visual data, such as a microphone and/or digital camera, a geographic location sensor for determining the location of the device, an input/output device such as a transceiver for sending and receiving data, a display for displaying digital images, one or more processors, and a memory in communication with the one or more processors.

The traffic safety system 308 may include programs (scripts, functions, algorithms) to configure data for visualizations and provide visualizations of datasets and data models on the user device 302. This may include programs to generate graphs and display graphs. The traffic safety system 308 may include programs to generate histograms, scatter plots, time series, or the like on the user device 302. The traffic safety system 308 may also be configured to display properties of data models and data model training results including, for example, architecture, loss functions, cross entropy, activation function values, embedding layer structure and/or outputs, convolution results, node outputs, or the like on the user device 302.

Network 306 may be of any suitable type, including individual connections via the internet such as cellular or WiFi networks. In some embodiments, network 306 may connect terminals, services, and mobile devices using direct connections such as RFID, NFC, Bluetooth™, low-energy BLE, WiFi™, ZigBee™, ABC protocols, USB, WAN, or LAN. Because the information transmitted may be personal or confidential, security concerns may dictate one or more of these types of connections be encrypted or otherwise secured. In some embodiments, however, the information being transmitted may be less personal, and therefore the network connections may be selected for convenience over security.

Network 306 may include any type of computer networking arrangement used to exchange data. For example, network 306 may be the Internet, a private data network, virtual private network using a public network, and/or other suitable connection(s) that enable(s) components in the system 300 environment to send and receive information between the components of system 100. Network 306 may also include a public switched telephone network ("PSTN") and/or a wireless network.

Traffic safety system 308 may be associated with and optionally controlled by one or more entities such as a business, corporation, individual, partnership, or any other entity that provides one or more of goods, services, and consultations to individuals such as customers. In some embodiments, traffic safety system 308 may be controlled by a third party on behalf of another business, corporation, individual, partnership. Traffic safety system 308 may include one or more servers and computer systems for performing one or more functions associated with products and/or services that the organization provides.

Web server 310 may include a computer system configured to generate and provide one or more websites accessible to customers, as well as any other individuals involved in access system 300's normal operations. Web server 310 may include a computer system configured to receive communications from user device 302 via for example, a mobile application, a chat program, an instant messaging program, a voice-to-text program, an SMS message, email, or any other type or format of written or electronic communication. Web server 310 may have one or more processors 322 and one or more web server databases 324, which may be any suitable repository of website data. Information stored in web server 310 may be accessed (e.g., retrieved, updated, and added to) via local network 312 and/or network 306 by one or more devices or systems (e.g., work zone map generation system 220) of system 300. In some embodiments, web server 310 may host websites or applications that may be accessed by user device 302. For example, web server 310 may host a financial service provider website that a user device may access by providing an attempted login that are authenticated by traffic safety system 308. According to some embodiments, web server 310 may include software tools, similar to those described with respect to user device 302, that may allow web server 310 to obtain network identification data from user device 302.

Local network 312 may include any type of computer networking arrangement used to exchange data in a localized area, such as WiFi, Bluetooth™ Ethernet, and other suitable network connections that enable components of traffic safety system 308 to interact with one another and to connect to network 306 for interacting with components in the system 300 environment. In some embodiments, local network 312 may include an interface for communicating with or linking to network 306. In other embodiments, certain components of traffic safety system 308 may communicate via network 306, without a separate local network 312.

The traffic safety system 308 may be hosted in a cloud computing environment (not shown). The cloud computing environment may provide software, data access, data storage, and computation. Furthermore, the cloud computing environment may include resources such as applications (apps), VMs, virtualized storage (VS), or hypervisors (HYP). User device 302 may be able to access traffic safety system 308 using the cloud computing environment. User device 302 may be able to access traffic safety system 308 using specialized software. The cloud computing environment may eliminate the need to install specialized software on user device 302.

In accordance with certain example implementations of the disclosed technology, traffic safety system 308 may include one or more computer systems configured to compile data from a plurality of sources, for example, work zone map generation system 220, web server 310, and/or database 316. Traffic safety system 308 may correlate compiled data, analyze the compiled data, arrange the compiled data, generate derived data based on the compiled data, and store the compiled and derived data in a database such as database 316. According to some embodiments, database 316 may be a database associated with an organization and/or a related entity that stores a variety of information relating to customers, transactions, ATM, and business operations. Database 316 may also serve as a back-up storage device and may contain data and information that is also stored on, for example, database 260, as discussed with reference to FIG. 2.

Embodiments consistent with the present disclosure may include datasets. Datasets may comprise actual data reflecting real-world conditions, events, and/or measurements. However, in some embodiments, disclosed systems and methods may fully or partially involve synthetic data (e.g., anonymized actual data or fake data). Datasets may involve numeric data, text data, and/or image data. For example, datasets may include transaction data, financial data, demographic data, public data, government data, environmental data, traffic data, network data, transcripts of video data, genomic data, proteomic data, and/or other data. Datasets of the embodiments may be in a variety of data formats including, but not limited to, PARQUET, AVRO, SQLITE, POSTGRESQL, MYSQL, ORACLE, HADOOP, CSV, JSON, PDF, JPG, BMP, and/or other data formats.

Datasets of disclosed embodiments may have a respective data schema (e.g., structure), including a data type, key-value pair, label, metadata, field, relationship, view, index, package, procedure, function, trigger, sequence, synonym, link, directory, queue, or the like. Datasets of the embodiments may contain foreign keys, for example, data elements that appear in multiple datasets and may be used to cross-reference data and determine relationships between datasets. Foreign keys may be unique (e.g., a personal identifier) or shared (e.g., a postal code). Datasets of the embodiments may be "clustered," for example, a group of datasets may share common features, such as overlapping data, shared statistical properties, or the like. Clustered datasets may share hierarchical relationships (e.g., data lineage).

Example Use Case

The following example use case describes an example of a typical user flow pattern. This section is intended solely for explanatory purposes and not in limitation.

In one example, a traffic safety manager may need to generate a traffic work zone for upcoming underground pipe work. The manager may log into his account via a mobile application. Within the mobile application, the manager may flip through a series of GUI displays to enter a request for a traffic work zone, including one or more details associated with the work zone. For example, the manager may enter a location (e.g., an address), start and end dates, and start and end times of the work zone. Upon receiving such details, the system may be configured to retrieve one or more regulations associated with the work zone location, such as any applicable national, state, or local regulations that may dictate how the work zone must be designed. Based on the regulations, the system may determine one or more required materials for the work zone, and may generate a map of the work zone location along with the required materials overlaid on the map. From the manager's perspective, he may click a button within the mobile application, such as a button that says: "generate work zone" or "start work zone," and may then see a new screen appear displaying the map and overlaid materials. The manager may then be able to travel to the work site and work with his employees to lay out the work zone according to the map and materials depicted via the mobile application. Additionally, the manager may be able to submit the generated work zone map and materials to a relevant government department such as Virginia Department of Transportation.

In some embodiments, the system may be configured to continuously track a GPS location of the manager's mobile device. As the manager walks or drives along the work zone route, he may receive alerts via the mobile application, each alert indicating he should position a specific material, such as a cone, at a respective position along the work zone route.

In some examples, disclosed systems or methods may involve one or more of the following clauses:

Clause 1: A dynamic traffic safety system comprising: one or more processors; and a memory in communication with the one or more processors and storing instructions that, when executed by the one or more processors, are configured to cause the system to: cause a user device to display a first graphical user interface (GUI) that includes a plurality of editable fields associated with a traffic work zone; receive, via the first GUI, one or more selections associated with the plurality of editable fields, wherein at least one of the one or more selections comprises a work zone location; responsive to receiving the one or more selections: retrieve, via a database, one or more regulations associated with the work zone location; determine, based on the one or more regulations, one or more required materials associated with the work zone location; generate a second GUI configured to display a map of the work zone location and at least one of the one or more required materials overlaid on the map; and cause the user device to display the second GUI.

Clause 2: The system of clause 1, wherein the plurality of editable fields correspond to one or more of an address, a street name, a date, a start time, an end time, a work zone purpose, a work zone type, an employee name, employee identification information, employee experience level, or combinations there.

Clause 3: The system of clause 1, wherein the one or more required materials comprise a flag, a cone, a sign, a marker, or combinations thereof.

Clause 4: The system of clause 1, wherein the instructions are further configured to cause the system to: responsive to receiving the one or more selections, iteratively, until each of the one or more required materials has been placed at a respective position within the work zone location: receive location data associated with the user device; responsive to receiving the location data, determine whether the user device has reached a first position within the work zone location; and responsive to determining the user device has reached the first position, cause the user device to transmit an alert indicating a first material of the one or more required materials should be placed at the first position.

Clause 5: The system of clause 1, wherein the instructions are further configured to cause the system to: responsive to receiving the one or more selections, continuously receive location data associated with the user device; continuously determine a distance between the location data associated with the user device and a first position within the work zone location; continuously determine whether the distance is below a threshold level; cause the user device to dynamically display, via the second GUI, the distance; and cause the user device to display, via the second GUI, an indication that a first material of the one or more required materials should be placed at the first position when the distance is below a threshold level.

Clause 6: The system of clause 1, wherein the instructions are further configured to cause the system to: responsive to receiving the one or more selections, determine a distance associated with the work zone location; cause the user device to display the distance via the second GUI; determine one or more features associated with the work zone location; automatically modify the distance based on the one or more features; and cause the user device to display the modified distance via the second GUI.

Clause 7: The system of clause 6, wherein automatically modifying the distance comprises extending the distance.

Clause 8: The system of clause 1, wherein the instructions are further configured to cause the system to: receive, via a third GUI of the user device, a request to change at least a first selection of the one or more selections; responsive to receiving the request, determine, based on the one or more regulations, one or more updated required materials associated with the work zone location; modify the second GUI to generate a modified second GUI configured to display an updated map of the work zone location and the one or more updated required materials overlaid on the updated map; and cause the user device to display the modified second GUI.

Clause 9: The system of clause 1, wherein the second GUI is further configured to display a distance of the work zone location, the distance based on the work zone location and a speed limit corresponding to the work zone location.

Clause 10: A dynamic traffic safety system comprising: one or more processors; and a memory in communication with the one or more processors and storing instructions that, when executed by the one or more processors, are configured to cause the system to: generate a first graphical user interface (GUI) that includes a plurality of editable fields associated with a traffic work zone; cause a user device to display the first GUI; receive, via the first GUI, one or more selections associated with the plurality of editable fields, wherein at least one of the one or more selections comprises a work zone location; and responsive to receiving the one or more selections: determine one or more required materials associated with the work zone location; generate a second GUI configured to display a map of the work zone location; cause the user device to display the second GUI; receive location data associated with the user device; responsive to receiving the location data, determine whether the user device has reached a first position within the work zone location; and responsive to determining the user device has reached the first position, cause the user device to transmit a first alert indicating a first material of the one or more required materials should be placed at the first position.

Clause 11: The system of clause 10, wherein the plurality of editable fields correspond to one or more of an address, a street name, a date, a start time, an end time, a work zone purpose, a work zone type, an employee name, employee identification information, employee experience level, or combinations there.

Clause 12: The system of clause 10, wherein determining the one or more required materials is based on one or more regulations associated with the work zone location.

Clause 13: The system of clause 10, wherein the second GUI is further configured to display at least a first required material of the one or more required materials overlaid on the map.

Clause 14: The system of clause 10, wherein the instructions are further configured to cause the system to: receive, via a third GUI of the user device, a request to change at least a first selection of the one or more selections; responsive to receiving the request, modify the second GUI to generate a modified second GUI configured to display an updated map of the work zone location; and cause the user device to display the modified second GUI.

Clause 15: A dynamic traffic safety system comprising: one or more processors; and a memory in communication with the one or more processors and storing instructions that, when executed by the one or more processors, are configured to cause the system to: receive, via a first graphical user interface (GUI) of a user device, a first request to generate a traffic work zone, the first request comprising at least a location of the traffic work zone; and responsive to receiving the first request: retrieve, via a database, one or more regulations associated with the location of the traffic work zone; determine, based on the one or more regulations, one or more required materials associated with the location of the traffic work zone; generate a second GUI configured to display a map of the location of the traffic work zone and at least one of the one or more required materials overlaid on the map; and cause the user device to display the second GUI.

Clause 16: The system of clause 15, wherein the one or more required materials comprise a flag, a cone, a sign, a marker, or combinations thereof.

Clause 17: The system of clause 15, wherein the instructions are further configured to cause the system to: receive, via a third GUI of the user device, a second request to modify the traffic work zone; responsive to receiving the second request, determine, based on the one or more regulations, one or more updated required materials associated with the modified traffic work zone; modify the third GUI to generate a modified third GUI configured to display an updated map of a location of the modified traffic work zone and the one or more updated required materials overlaid on the updated map; and cause the user device to display the modified third GUI.

Clause 18: The system of clause 15, wherein the first request comprises one or more of an address, a street name, a date, a start time, an end time, a work zone purpose, a work zone type, an employee name, employee identification information, employee experience level, or combinations there.

Clause 19: The system of clause 15, wherein the second GUI is further configured to display a distance of the traffic work zone, the distance based on the location of the traffic work zone and a speed limit corresponding to the location of the traffic work zone.

Clause 20: The system of clause 15, wherein the instructions are further configured to cause the system to: receive location data associated with the user device; responsive to receiving the location data, determine whether the user device has reached a first position within the traffic work zone; and responsive to determining the user device has reached the first position, cause the user device to transmit an alert indicating a first material of the one or more required materials should be placed at the first position.

The features and other aspects and principles of the disclosed embodiments may be implemented in various environments. Such environments and related applications may be specifically constructed for performing the various processes and operations of the disclosed embodiments or they may include a general-purpose computer or computing platform selectively activated or reconfigured by program code to provide the necessary functionality. Further, the processes disclosed herein may be implemented by a suitable combination of hardware, software, and/or firmware. For example, the disclosed embodiments may implement general purpose machines configured to execute software programs that perform processes consistent with the disclosed embodiments. Alternatively, the disclosed embodiments may implement a specialized apparatus or system configured to execute software programs that perform processes consistent with the disclosed embodiments. Furthermore, although some disclosed embodiments may be implemented by general purpose machines as computer processing instructions, all or a portion of the functionality of the disclosed embodiments may be implemented instead in dedicated electronics hardware.

The disclosed embodiments also relate to tangible and non-transitory computer readable media that include program instructions or program code that, when executed by one or more processors, perform one or more computer-implemented operations. The program instructions or program code may include specially designed and constructed instructions or code, and/or instructions and code well-known and available to those having ordinary skill in the computer software arts. For example, the disclosed embodiments may execute high level and/or low-level software instructions, such as machine code (e.g., such as that produced by a compiler) and/or high-level code that can be executed by a processor using an interpreter.

The technology disclosed herein typically involves a high-level design effort to construct a computational system that can appropriately process unpredictable data. Mathematical algorithms may be used as building blocks for a framework, however certain implementations of the system may autonomously learn their own operation parameters, achieving better results, higher accuracy, fewer errors, fewer crashes, and greater speed.

As used in this application, the terms "component," "module," "system," "server," "processor," "memory," and the like are intended to include one or more computer-related units, such as but not limited to hardware, firmware, a combination of hardware and software, software, or software in execution. For example, a component may be, but is not limited to being, a process running on a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Certain embodiments and implementations of the disclosed technology are described above with reference to block and flow diagrams of systems and methods and/or computer program products according to example embodiments or implementations of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, may be repeated, or may not necessarily need to be performed at all, according to some embodiments or implementations of the disclosed technology.

These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks.

As an example, embodiments or implementations of the disclosed technology may provide for a computer program product, including a computer-usable medium having a computer-readable program code or program instructions embodied therein, said computer-readable program code adapted to be executed to implement one or more functions specified in the flow diagram block or blocks. Likewise, the computer program instructions may be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

Certain implementations of the disclosed technology described above with reference to user devices may include mobile computing devices. Those skilled in the art recognize that there are several categories of mobile devices, generally known as portable computing devices that can run on batteries but are not usually classified as laptops. For example, mobile devices can include, but are not limited to portable computers, tablet PCs, internet tablets, PDAs, ultra-mobile PCs (UMPCs), wearable devices, and smart phones. Additionally, implementations of the disclosed technology can be utilized with internet of things (IoT) devices, smart televisions and media devices, appliances, automobiles, toys, and voice command devices, along with peripherals that interface with these devices.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Although embodiments are described herein with respect to systems or methods, it is contemplated that embodiments with identical or substantially similar features may alternatively be implemented as systems, methods and/or non-transitory computer-readable media.

As used herein, unless otherwise specified, the use of the ordinal adjectives "first," "second," "third," etc., to describe a common object, merely indicates that different instances of like objects are being referred to, and is not intended to imply that the objects so described must be in a given sequence, either temporally, spatially, in ranking, or in any other manner.

While certain embodiments of this disclosure have been described in connection with what is presently considered to be the most practical and various embodiments, it is to be understood that this disclosure is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dynamic traffic safety system comprising:

one or more processors; and a memory in communication with the one or more processors and storing instructions that, when executed by the one or more processors, are configured to cause the system to:

cause a user device to display a first graphical user interface (GUI) that includes a plurality of editable fields associated with a traffic work zone;

receive, via the first GUI, one or more selections associated with the plurality of editable fields, wherein at least one of the one or more selections comprises a work zone location;

responsive to receiving the one or more selections:

retrieve, via a database, one or more regulations associated with the work zone location;

determine, based on the one or more regulations, one or more required materials associated with the work zone location;

generate a second GUI configured to display a map of the work zone location and at least one of the one or more required materials overlaid on the map; and cause the user device to display the second GUI;

continuously receive location data associated with the user device;

continuously determine a distance between the location data associated with the user device and a first position within the work zone location;

continuously determine whether the distance is below a threshold level;

cause the user device to dynamically display, via the second GUI, the distance; and cause the user device to display, via the second GUI, an indication that a first material of the one or more required materials should be placed at the first position when the distance is below a threshold level.

2. The system of claim 1, wherein the plurality of editable fields correspond to one or more of an address, a street name, a date, a start time, an end time, a work zone purpose, a work zone type, an employee name, employee identification information, employee experience level, or combinations there.

3. The system of claim 1, wherein the one or more required materials comprise a flag, a cone, a sign, a marker, or combinations thereof.

4. The system of claim 1, wherein the instructions are further configured to cause the system to:

responsive to receiving the one or more selections, iteratively, until each of the one or more required materials has been placed at a respective position within the work zone location:

receive location data associated with the user device;

responsive to receiving the location data, determine whether the user device has reached a first position within the work zone location; and responsive to determining the user device has reached the first position, cause the user device to transmit an alert indicating a first material of the one or more required materials should be placed at the first position.

5. The system of claim 1, wherein the instructions are further configured to cause the system to:

receive, via a third GUI of the user device, a request to change at least a first selection of the one or more selections;

responsive to receiving the request, determine, based on the one or more regulations, one or more updated required materials associated with the work zone location;

modify the second GUI to generate a modified second GUI configured to display an updated map of the work zone location and the one or more updated required materials overlaid on the updated map; and cause the user device to display the modified second GUI.

6. The system of claim 1, wherein the second GUI is further configured to display a distance of the work zone location, the distance based on the work zone location and a speed limit corresponding to the work zone location.

7. A dynamic traffic safety system comprising:

one or more processors; and a memory in communication with the one or more processors and storing instructions that, when executed by the one or more processors, are configured to cause the system to:

cause a user device to display a first graphical user interface (GUI) that includes a plurality of editable fields associated with a traffic work zone;

receive, via the first GUI, one or more selections associated with the plurality of editable fields, wherein at least one of the one or more selections comprises a work zone location;

responsive to receiving the one or more selections:

generate a second GUI configured to display a map of the work zone location and at least one of one or more required materials overlaid on the map;

determine one or more features associated with the work zone location;

determine a distance based on the one or more features; and cause the user device to display the distance via the second GUI.

8. A dynamic traffic safety system comprising:

one or more processors; and a memory in communication with the one or more processors and storing instructions that, when executed by the one or more processors, are configured to cause the system to:

generate a first graphical user interface (GUI) that includes a plurality of editable fields associated with a traffic work zone;

cause a user device to display the first GUI;

receive, via the first GUI, one or more selections associated with the plurality of editable fields, wherein at least one of the one or more selections comprises a work zone location; and responsive to receiving the one or more selections:

determine one or more required materials associated with the work zone location;

generate a second GUI configured to display a map of the work zone location;

cause the user device to display the second GUI;

continuously receive location data associated with the user device;

continuously determine whether the user device has reached a first position within the work zone location; and responsive to determining the user device has reached the first position, cause the user device to display, via the second GUI, an indication that a first material of the one or more required materials should be placed at the first position.

9. The system of claim 8, wherein the plurality of editable fields correspond to one or more of an address, a street name, a date, a start time, an end time, a work zone purpose, a work zone type, an employee name, employee identification information, employee experience level, or combinations there.

10. The system of claim 8, wherein determining the one or more required materials is based on one or more regulations associated with the work zone location.

11. The system of claim 8, wherein the second GUI is further configured to display at least a first required material of the one or more required materials overlaid on the map.

12. The system of claim 8, wherein the instructions are further configured to cause the system to:

receive, via a third GUI of the user device, a request to change at least a first selection of the one or more selections;

responsive to receiving the request, modify the second GUI to generate a modified second GUI configured to display an updated map of the work zone location; and cause the user device to display the modified second GUI.

13. A dynamic traffic safety system comprising:

one or more processors; and a memory in communication with the one or more processors and storing instructions that, when executed by the one or more processors, are configured to cause the system to:

receive, via a first graphical user interface (GUI) of a user device, a first request to generate a traffic work zone, the first request comprising at least a location of the traffic work zone; and responsive to receiving the first request:

retrieve, via a database, one or more regulations associated with the location of the traffic work zone;

determine, based on the one or more regulations, one or more required materials associated with the location of the traffic work zone;

generate a second GUI configured to display a map of the location of the traffic work zone and at least one of the one or more required materials overlaid on the map; and continuously receive location data associated with the user device;

continuously determine a distance between the location data associated with the user device and a first position within the traffic work zone;

continuously determine whether the distance is below a threshold level;

cause the user device to dynamically display, via the second GUI, the distance; and cause the user device to display, via the second GUI, an indication that a first material of the one or more required materials should be placed at the first position when the distance is below a threshold level.

14. The system of claim 13, wherein the one or more required materials comprise a flag, a cone, a sign, a marker, or combinations thereof.

15. The system of claim 13, wherein the instructions are further configured to cause the system to:

receive, via a third GUI of the user device, a second request to modify the traffic work zone;

responsive to receiving the second request, determine, based on the one or more regulations, one or more updated required materials associated with the modified traffic work zone;

modify the third GUI to generate a modified third GUI configured to display an updated map of a location of the modified traffic work zone and the one or more updated required materials overlaid on the updated map; and cause the user device to display the modified third GUI.

16. The system of claim 13, wherein the first request comprises one or more of an address, a street name, a date, a start time, an end time, a work zone purpose, a work zone type, an employee name, employee identification information, employee experience level, or combinations there.

17. The system of claim 13, wherein the second GUI is further configured to display a distance of the traffic work zone, the distance based on the location of the traffic work zone and a speed limit corresponding to the location of the traffic work zone.

18. The system of claim 13, wherein the instructions are further configured to cause the system to:

receive location data associated with the user device;

responsive to receiving the location data, determine whether the user device has reached a first position within the traffic work zone; and responsive to determining the user device has reached the first position, cause the user device to transmit an alert indicating a first material of the one or more required materials should be placed at the first position.

* * * * *